US012180835B2

(12) United States Patent
Koekemoer et al.

(10) Patent No.: US 12,180,835 B2
(45) Date of Patent: Dec. 31, 2024

(54) SCREEN HANDLING SYSTEM

(71) Applicant: Joy Global Underground Mining LLC, Warrendale, PA (US)

(72) Inventors: Renier Koekemoer, Sudbury (CA); Joseph St. Amand, Elliot Lake (CA); Justin Barter, Algoma Mills (CA)

(73) Assignee: Joy Global Underground Mining LLC, Warrendale, PA (US)

( * ) Notice: Subject to any disclaimer, the term of this patent is extended or adjusted under 35 U.S.C. 154(b) by 10 days.

(21) Appl. No.: 17/853,599

(22) Filed: Jun. 29, 2022

(65) Prior Publication Data

US 2023/0003125 A1 Jan. 5, 2023

Related U.S. Application Data

(60) Provisional application No. 63/216,967, filed on Jun. 30, 2021.

(51) Int. Cl.
*E21D 11/15* (2006.01)

(52) U.S. Cl.
CPC ..... *E21D 11/152* (2013.01)

(58) Field of Classification Search
CPC ..... E21D 11/152; E21D 21/00; E21D 20/003; E01F 7/045; E02D 3/00
See application file for complete search history.

(56) References Cited

U.S. PATENT DOCUMENTS 8,137,033 B1 * 3/2012 Hinshaw ..... E21D 11/40 405/302.3
8,956,082 B2 * 2/2015 Nelson ..... E21B 19/086 405/259.1
9,187,873 B2 * 11/2015 Nelson ..... E21D 11/152
2014/0294514 A1 10/2014 Nelson

FOREIGN PATENT DOCUMENTS

AU 2014200223 A1 10/2014
CA 2811722 A1 10/2014
CA 2900835 C 7/2017
WO 2017100806 A1 6/2017
(Continued)

OTHER PUBLICATIONS

Partial European Search Report for Application No. 22182164.8 dated Oct. 31, 2022 (13 pages).
(Continued)

*Primary Examiner* — Nathaniel C Chukwurah
(74) *Attorney, Agent, or Firm* — Husch Blackwell LLP

(57) ABSTRACT

A screen handling system is provided for a rock drilling device including a feed assembly, at least one rail system supporting the feed assembly for translational movement relative to a boom along a first axis, and an actuator for advancing a bit or bolt into a rock face parallel to the first axis. The screen handling system includes a pad disposed proximate the bit or bolt, a block having a bore that defines a second axis parallel to the first axis, a gripper at least partially disposed within and axially moveable relative to the bore in a direction along the second axis, and a drive mechanism coupled to the block that is capable of continuously rotating the pad about the second axis to a desired orientation.

23 Claims, 7 Drawing Sheets

(56) References Cited

FOREIGN PATENT DOCUMENTS

WO 2020165346 A1 8/2020

OTHER PUBLICATIONS

Extended European Search Report for Application No. 22182164.8 dated Jan. 31, 2023 (11 pages).
Chilean Examination Report for Application No. 202201791 dated Jan. 26, 2024 (17 pages).
Canadian Office Action for Application No. 3166168 dated Dec. 27, 2023 (5 pages).
Chilean Examination and Search Report for Application No. 202201791 dated Sep. 5, 2024, 24 pages.

* cited by examiner

SCREEN HANDLING SYSTEM

CROSS-REFERENCE TO RELATED APPLICATION

This application claims priority to, prior-filed U.S. Provisional Patent Application No. 63/216,967, filed on Jun. 30, 2021, the entire contents of which are incorporated by reference herein.

TECHNICAL FIELD

The present disclosure relates to rock drilling and bolting devices.

In order to prevent rock falls in a mine, a support member (e.g., a wire screen) may be secured adjacent a rock face by one or more bolts. In some applications, the installation of a rock bolt includes drilling a hole in a rock face and inserting a bolt through the support member and into the drilled hole, thereby securing the support member against the rock face.

SUMMARY

In one independent aspect, a screen handling system is provided for a rock drilling device. The rock drilling device includes a feed assembly, at least one rail system supporting the feed assembly for translational movement relative to the boom along a first axis, and an actuator for advancing a bit or bolt into a rock face parallel to the first axis. The screen handling system includes a pad disposed proximate the bit or bolt, a block having a bore that defines a second axis parallel to the first axis, and a gripper at least partially disposed within and axially moveable relative to the bore in a direction along the second axis. The screen handling system further includes a drive mechanism coupled to the block that is capable of continuously rotating the pad about the second axis to a desired orientation.

In another independent aspect, a rock drilling device for use on a boom of a mining machine includes a feed assembly; a first frame at least partially supported by the feed assembly for translational movement relative to the boom along a first axis and a second frame supported for translational movement relative to the first frame; a drill feed coupled to the second frame for rotating and advancing a bit or bolt into a rock face along a second axis that is parallel to the first axis; and a screen handler coupled to the first rail system and configured to connect to and maneuver a screen relative to the rock face by rotating the screen through an infinite number of rotations.

In yet another independent aspect, a method of installing a screen on a rock face includes grasping the screen with a stinger assembly by securing a portion of the screen between a pad and a gripper, actuating a feed assembly that supports the stinger assembly to extend toward the rock face until the screen is adjacent the rock face, continuously rotating the pad and the screen via a slew drive mechanism to precisely position the screen in a desired orientation relative to the mine face, and engaging the gripper against the rock face to stabilize the feed assembly relative to the rock face. The method further includes driving a bit or bolt through the screen and into the rock face to hold the screen against the rock face.

Other aspects will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, whether direct or indirect. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
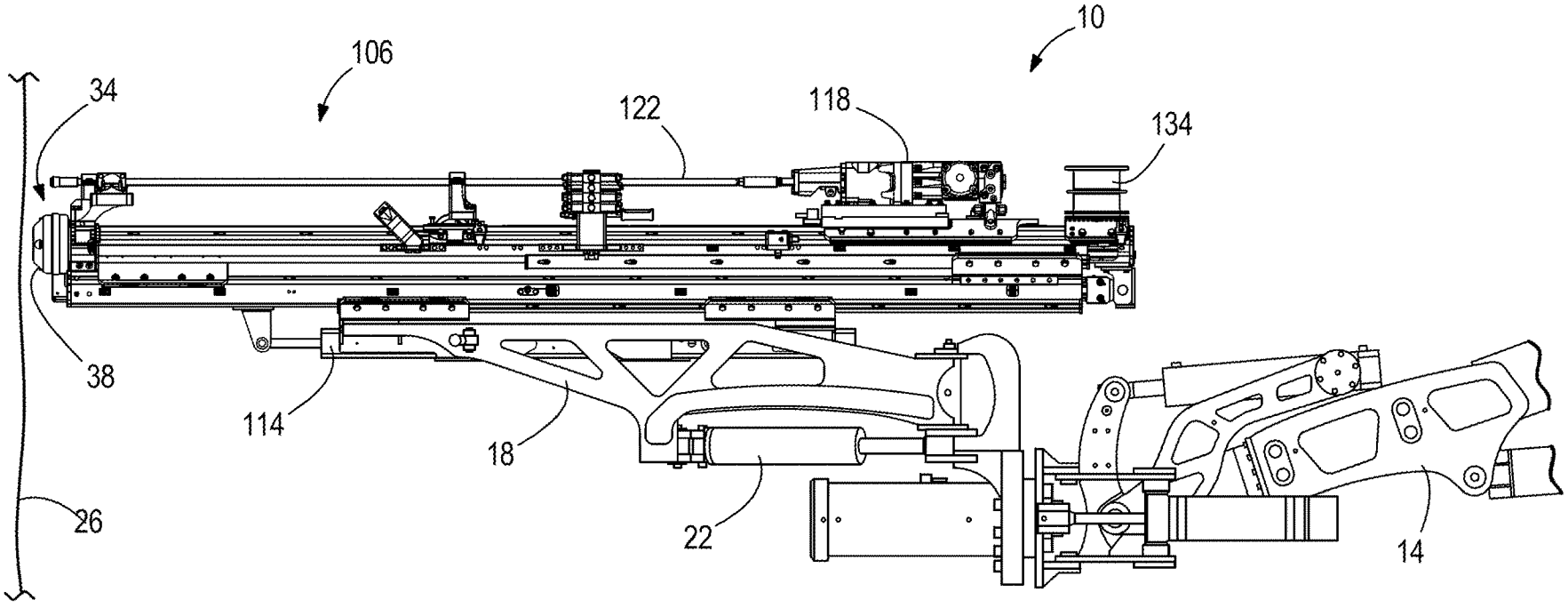
FIG. 1 is a side view of a screen handling system of a feed assembly supported on a boom.

FIG. 1 illustrates a feed assembly 10 supported on a boom 14 of a mining machine. Specifically, the feed assembly 10 includes a mounting frame 18 that is pivotably coupled to the boom 14 and moveable relative thereto via one or more boom actuators 22 (e.g., hydraulic cylinders, rotary motors, etc.). In general, the mining machine is positioned within a mine and the boom 14 supports the feed assembly 10 to be positioned in a desired orientation adjacent a rock face 26.

Figure 2:
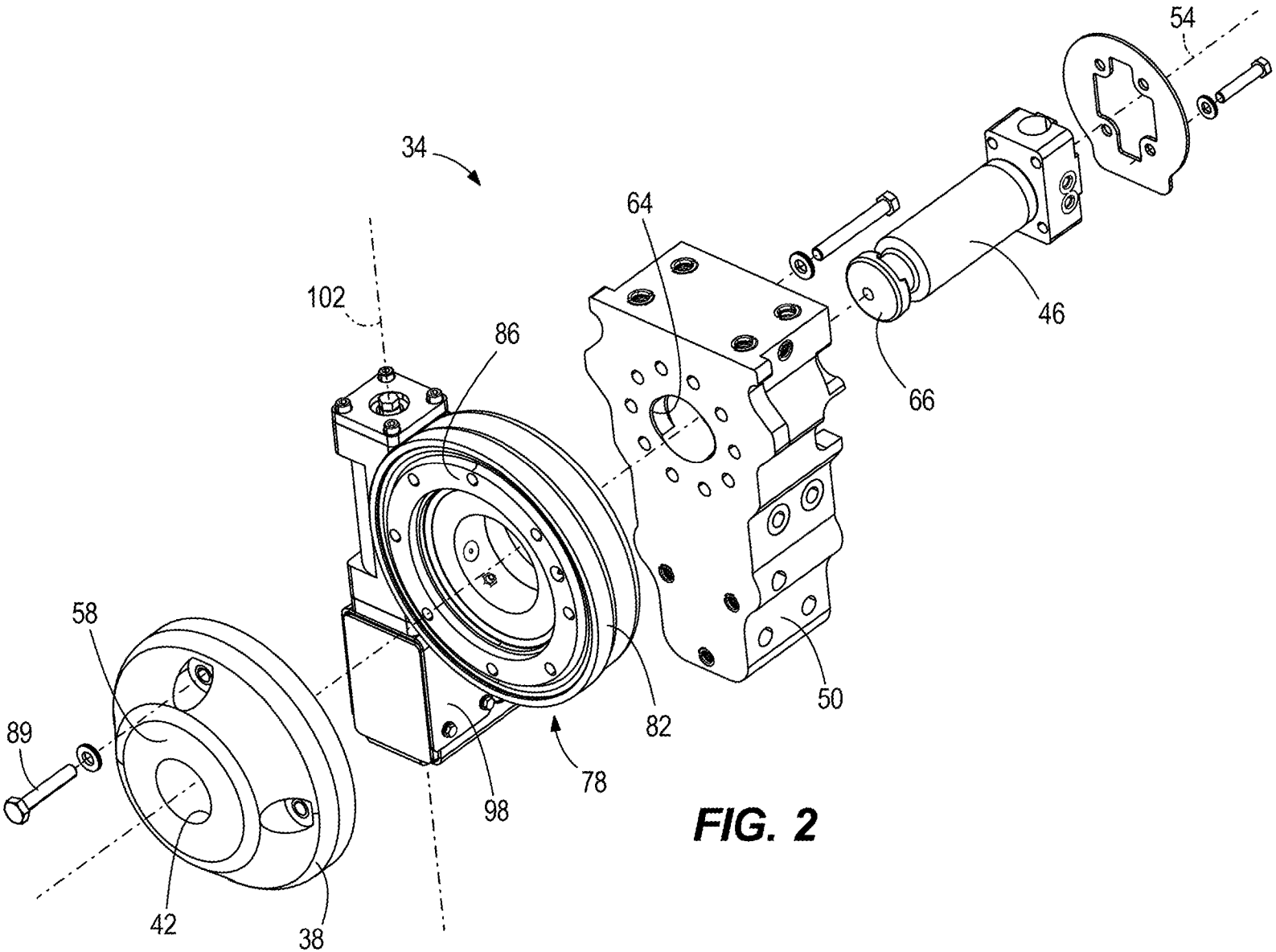
FIG. 2 is an exploded perspective view of a stinger assembly.
Figure 3:
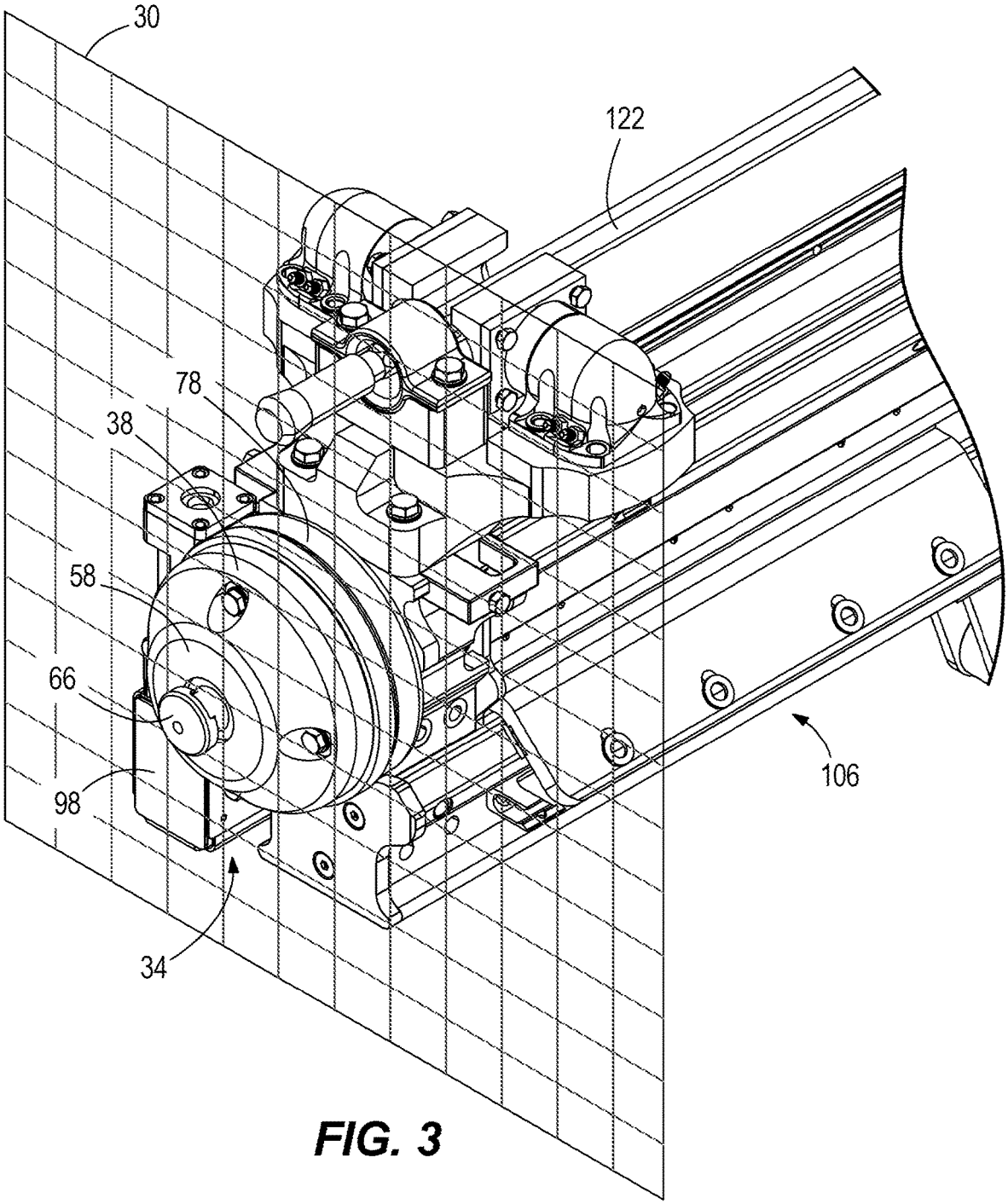
FIG. 3 is a perspective view of the stinger assembly of FIG. 2, illustrating a gripper engaging a screen.
Figure 4:
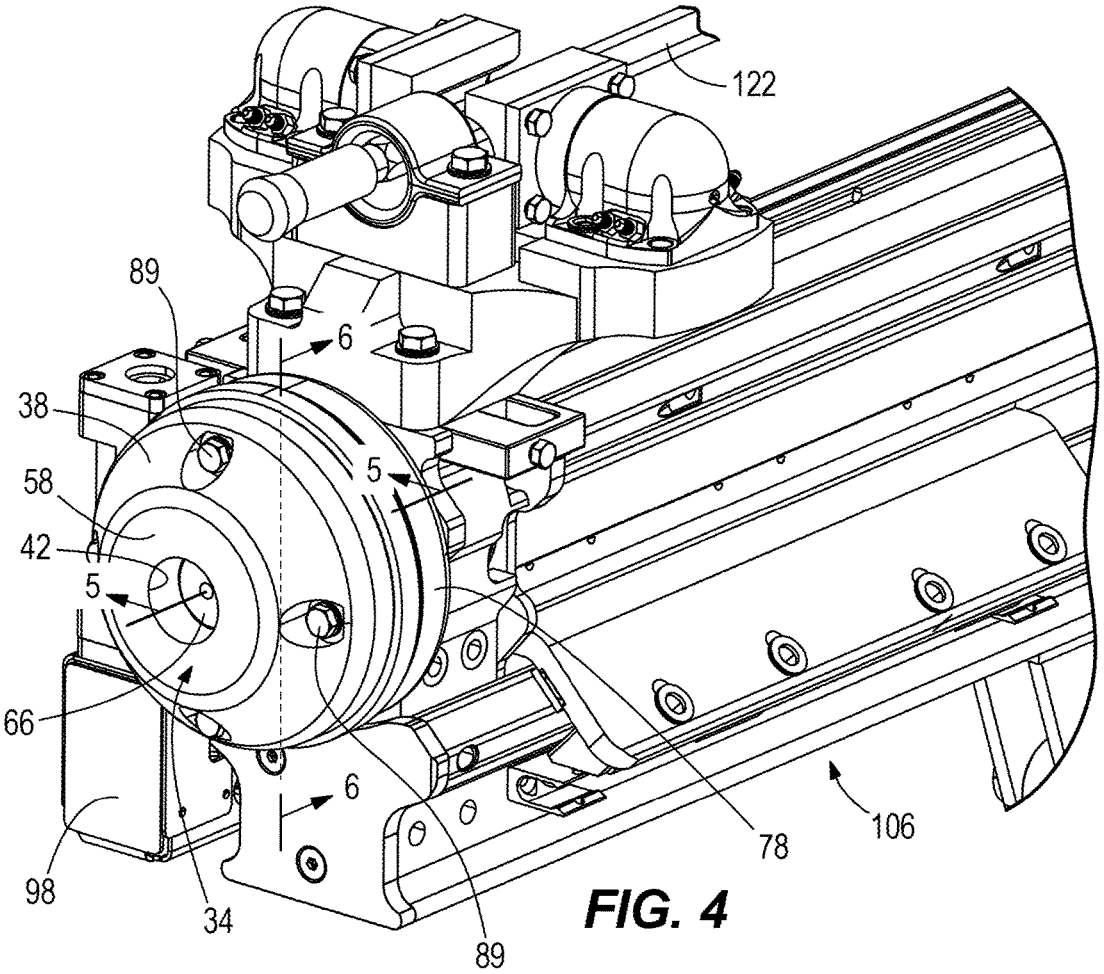
FIG. 4 is a perspective view of the stinger assembly of FIG. 2, illustrating a gripper in a retracted position.

With reference to FIGS. 2-4, the screen handling system includes a stinger assembly 34 that is capable of engaging and maneuvering a support member (e.g., a screen 30—FIG. 3) against the rock face 26. As shown in FIG. 2, the stinger assembly 34 includes a stinger pad 38 having an aperture 42, a finger gripper 46 that may engage (e.g., hook around a portion of) the mesh screen (FIG. 3), and a stinger block 50 that supports the finger gripper cylinder 46 for movement. Specifically, the finger gripper 46 is moveable along a stinger axis 54 between a retracted position (FIG. 4), in which the finger gripper cylinder 46 does not extend beyond a front face 58 of the stinger pad 38, and an extended position (FIG. 3), in which the finger gripper cylinder 46 extends beyond the front face 58 of the stinger pad 38 through the aperture 42.

Figure 5:
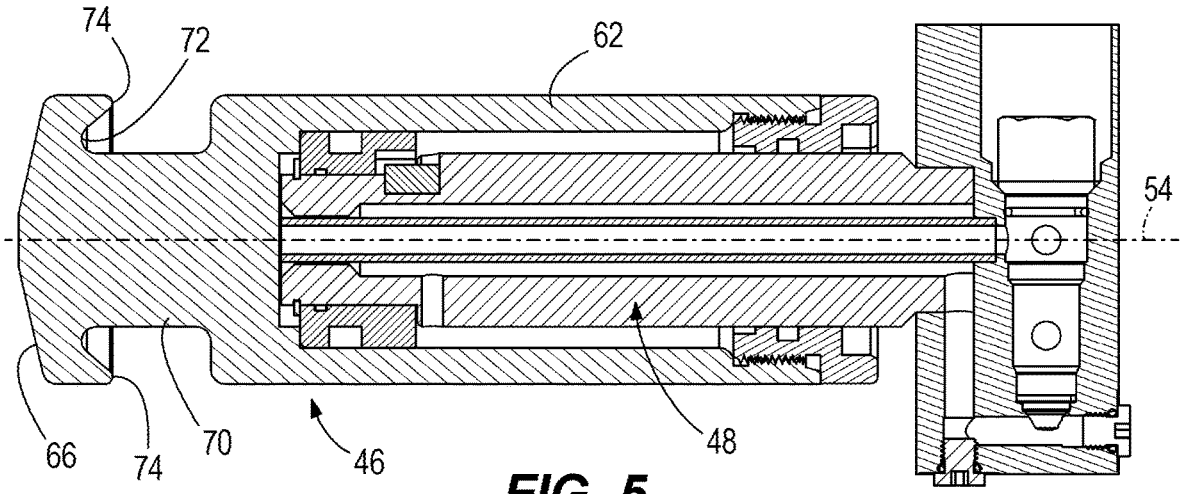
FIG. 5 is a cross-sectional view of the stinger assembly of FIG. 4, viewed along section 5-5 of FIG. 4.

With reference to FIG. 5, the gripper 46 is part of an actuator subassembly 48. The gripper 46 is driven hydraulically between the retracted and the extended position. The gripper 46 includes a main body 62 that is at least partially supported within a bore 64 (FIG. 2) of the stinger block 50, a head 66, and a neck 70 positioned between the main body 62 and the head 66. In the illustrated embodiment, the head 66 has a convex or conical profile to facilitate movement of the head 66 through a wire segment of the screen 30 and subsequent gripping of the screen 30 via the head 66. The neck 70 has a reduced-diameter relative to the head 66, thereby allowing a portion of the head 66 (e.g., an outer periphery of the head 66) to engage and hold the mesh screen 30. In the illustrated embodiment, the portion of the head 66 includes a shoulder 72 having a plurality of hooks 74 that extend rearwardly from the head 66 in a direction parallel to the stinger axis 54. Each hook 74 is configured to hook around a portion of the screen 30. The finger gripper 46 is moved to the extended position, enabling the head 66 to extend through and engage the screen 30. The finger gripper 46 may then be retracted along the stinger axis 54 until the portion of the screen 30 is secured between the head 66 of the finger gripper 46 and the front face 58 of the stinger pad 38. The head 66 protrudes beyond the front face 58 of the stringer pad 38 while the screen 30 is secured due to a mechanical interference with the screen 30 lodged in the neck 70. The screen 30 may be maneuvered into a desired position and orientation relative to the rock face 26.

Figure 6:
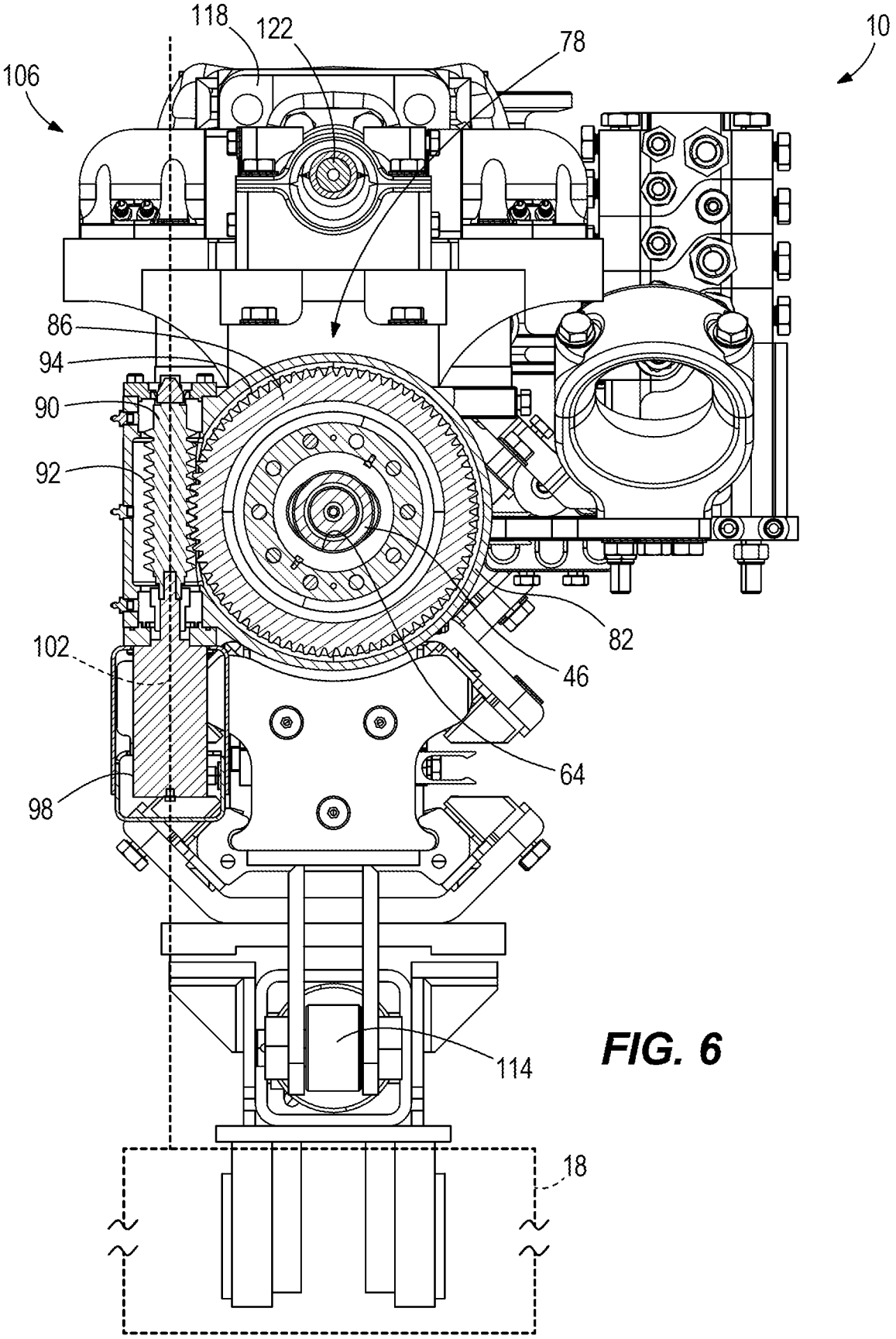
FIG. 6 is a cross-sectional view of the stinger assembly of FIG. 4, viewed along section 6-6 of FIG. 4.

With reference to FIG. 6, the stinger assembly 34 further includes a drive mechanism (e.g., hydraulic slew drive 78). The hydraulic slew drive mechanism 78 is supported by the stinger block 50 (as shown in FIG. 2) and includes a housing 82, a worm wheel 86 disposed within the housing 82, and a threaded shaft or worm gear 90 that engages and drives the worm wheel 86 for rotation about the stinger axis 54. In the illustrated embodiment, the worm gear 90 includes helical teeth 92 that engage corresponding helical teeth 94 of the worm wheel 86. A gear ratio between the worm gear 90 and the worm wheel 86 determines a rotational output of a hydraulic motor 98 to the worm wheel 86. The worm gear 90 is driven by the hydraulic motor 98 about a motor axis 102 that is perpendicular to the stinger axis 54. As shown in FIG. 2, the stinger pad 38 is coupled to the worm wheel 82 (e.g., via bolts 89) for co-rotation therewith.

The slew drive mechanism 78 permits the worm wheel 82 (and therefore the stinger pad 38) to be continuously and completely rotated about the stinger axis 54 and may be rotated to any number of positions or orientations. Stated another way, the worm gear 86 can drive the worm wheel 82 (and therefore the stinger pad 38) through virtually infinite rotations. Since the screen 30 is forcibly held against the stinger pad 38 by the finger gripper 46, the screen 30 rotates with the stinger pad 38 and can be precisely oriented and/or positioned relative to the rock face 26. When the hydraulic motor 98 is deactivated, the stinger pad 38 immediately stops rotating due to a fixed gear ratio between the worm wheel 86 and the worm gear 90 even though the screen may exert a reaction torque (e.g., due to rotational inertia) on the stinger pad 38 when stopped abruptly. In addition, the slew drive mechanism 78 provides a compact drive mechanism that permits the stinger assembly to have a shorter length than conventional screen handling devices. The compact length reduces the amount of weight that is supported in a cantilevered manner by the boom 14, thereby also reducing the counterweight needed to maintain balance for the feed assembly 10.

Figure 7:
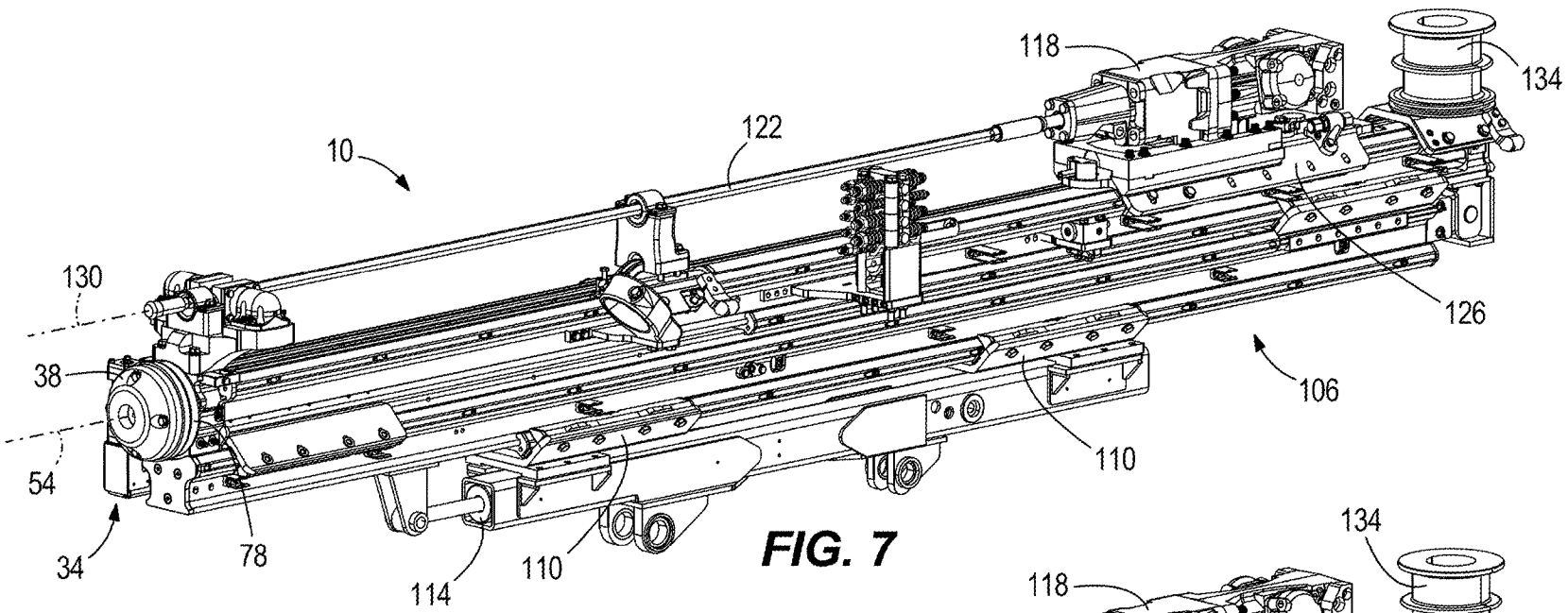
FIG. 7 is a perspective view of the feed assembly of FIG. 1 in a first position.
Figure 8:
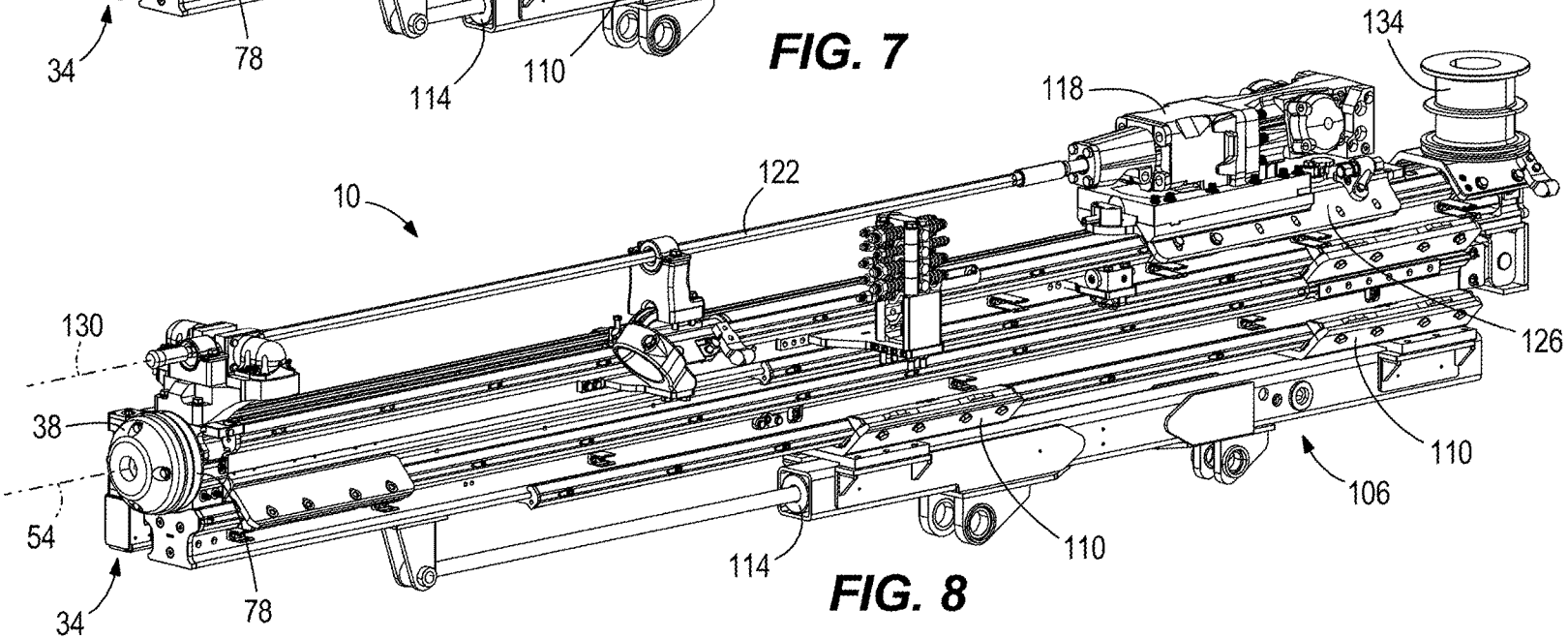
FIG. 8 is a perspective view of the feed assembly of FIG. 1 in a second position.

With reference to FIGS. 7 and 8, the stinger assembly 34 is supported on the feed assembly 10 that is capable of extending and retracting the stinger assembly 34 along the stinger axis 54 relative to the mounting frame 18. Specifically, a first rail system 110 couples the feed assembly 10 for translation relative to the mounting frame 18. A feed actuator (e.g. a hydraulic cylinder 114) is coupled between the mounting frame 18 and the feed assembly 10, and is actuatable to move the feed assembly 10 along the first rail system 110 between a first position (FIG. 7) and a second position (FIG. 8). In the first position, the stinger assembly 34 may be spaced away from the rock face 26 (FIG. 1). The feed actuator 114 can actuate the feed assembly 10 toward the second position at which the stinger assembly 34 is positioned adjacent the rock face 26. Placing the stinger assembly 34 against the mine face 26 (sometimes referred to as "stinging the face"), the feed assembly 10 is held stable against the rock face 26 to inhibit the screen handling system from moving relative to the rock face 26 during a drilling and bolting operation.

With continued reference to FIGS. 7 and 8, the feed assembly 10 further includes a drill feed 118, consumable 122 (e.g., a drill bit, resin cartridge, bolt, etc.), and a second rail system 126 that supports the drill feed 118 for translational movement along drill axis 130. In some embodiments, the drill feed 118 rotationally drives (e.g., via a motor) and advances a drill bit 122 into the rock face 26 as the drill feed 118 translates along the second rail system 126. A hydraulic actuator, belt drive, or some other linear actuator moves the drill feed 118 along the second rail system 126. In some embodiments, the feed assembly 10 further includes a cable handler 134 that facilitates gathering and guiding drill feed cables (not shown) as the drill feed 118 translates. Once a hole is formed in the rock face 26, the drill bit 122 can be removed from the drill feed 118 and a resin cartridge and/or rock bolt (not shown) may subsequently be coupled to and driven by the drill feed 118 through the mesh screen 30 and into the rock face 26.

Figure 9:
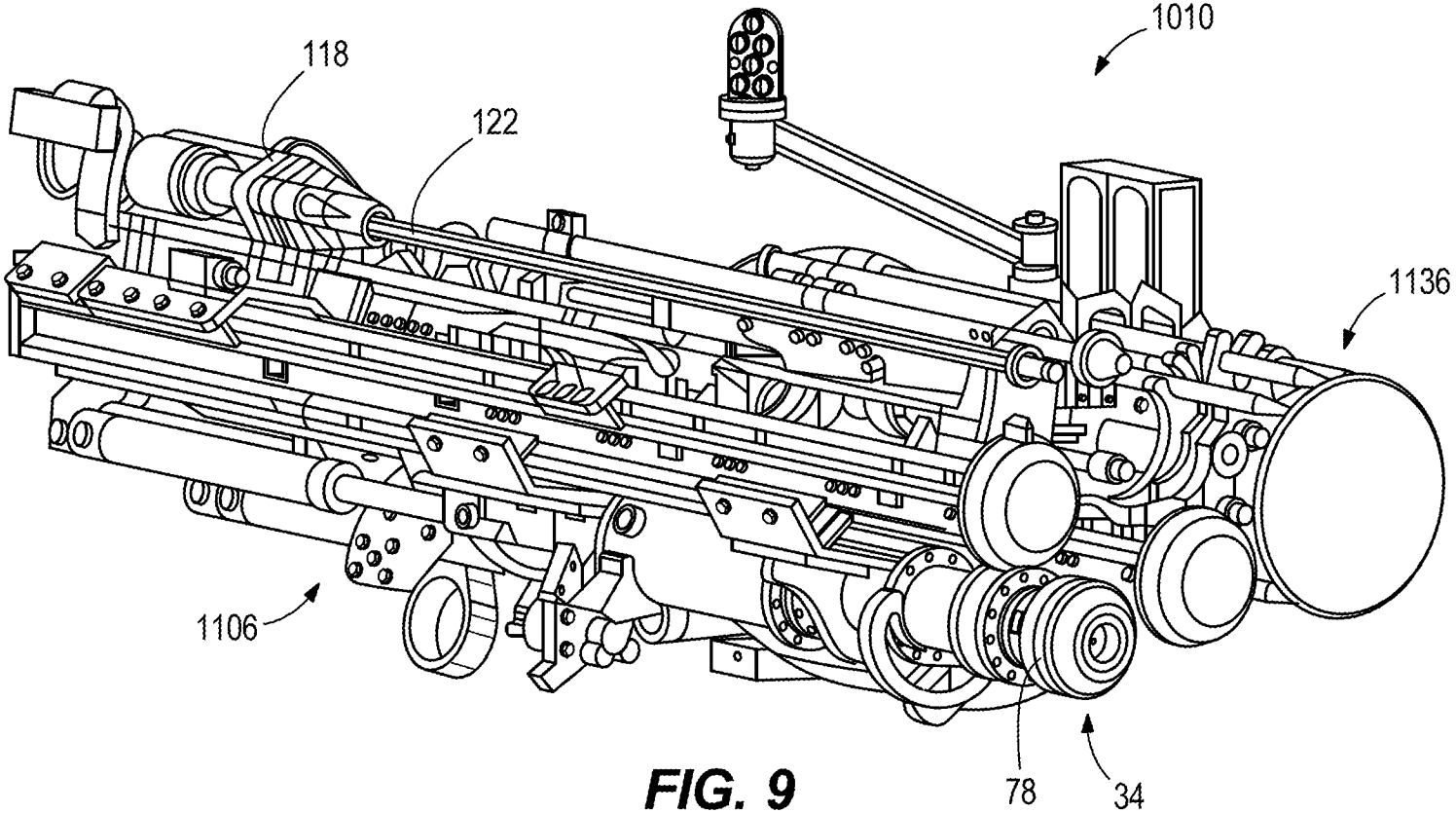
FIG. 9 is a perspective view of a screen handling system in accordance with another embodiment.

Although the screen handler system is illustrated and described above with respect to a feed assembly, in other embodiments, a similar screen handler system may be supported on a bolting assembly 1106, as shown in FIG. 9. The bolting assembly 1106 may include a stinger assembly 34 with the hydraulic slew drive mechanism 78, the drill feed 118, and the rock drill 122. Furthermore, the bolting assembly 1106 may include a carousel 1136 for holding various tools used during the drilling and bolting operation.

Although the disclosure has been described in detail with reference to certain preferred embodiments, variations and modifications exist within the scope and spirit of one or more independent aspects of the disclosure as described. Various features and advantages of the disclosure are set forth in the following claims.

What is claimed is:

1. A screen handling system for a rock drilling device, the rock drilling device including a feed assembly, at least one rail system supporting the feed assembly for translational movement relative to a boom along a first axis, and an actuator for advancing a consumable into a rock face parallel to the first axis, the screen handling system comprising:

a pad disposed proximate the consumable;

a block having a bore that defines a second axis parallel to the first axis;

a gripper at least partially disposed within and axially moveable relative to the bore in a direction along the second axis; and a drive mechanism coupled to the block that is capable of continuously rotating the pad about the second axis to a desired orientation.

2. The screen handling system of claim 1, wherein the gripper includes a main body that is driven axially by a hydraulic actuator, a head spaced away from the main body, and a neck that connects the head to the main body.

3. The screen handling system of claim 2, wherein the neck has a reduced-diameter relative to both the main body and the head.

4. The screen handling system of claim 2, wherein the head is conically-shaped and includes a shoulder with a plurality of hooks that extend away from the head in a direction parallel to the second axis for hooking a mesh screen.

5. The screen handling system of claim 4, wherein the gripper is moveable between a retracted position, in which the head of the gripper does not extend beyond a front face of the pad, and an extended position, in which the head of the gripper extends beyond the front face of the pad.

6. The screen handling system of claim 5, wherein the gripper is retracted from the extended position toward the retracted position once the hooks grasp a portion of the mesh screen, at which point the mesh screen is forcibly held between the head of the gripper and the front face of the pad.

7. The screen handling system of claim 1, wherein the drive mechanism includes a hydraulic motor, a worm gear having helical teeth and driven by the hydraulic motor along a motor axis, and a worm wheel having corresponding helical teeth that mesh with the helical teeth of the worm gear.

8. The screen handling system of claim 7, wherein the worm wheel is driven by the worm gear about the second axis that is perpendicular to the motor axis.

9. The screen handling system of claim 7, wherein the pad is driven to rotate with the worm wheel.

10. The screen handling system of claim 7, wherein the pad is rotatably affixed to the worm wheel.

11. The screen handling system of claim 7, wherein the worm wheel and the pad are capable of being rotated together an infinite number of rotations about the second axis in a first direction and in a second direction.

12. The screen handling system of claim 7, wherein the pad is driven by the hydraulic motor based on a fixed gear ratio between the worm gear and the worm wheel, the hydraulic motor driving the rotation of the pad when the motor is activated and stopping the rotation of the pad when the motor is deactivated.

13. The screen handling system of claim 1, wherein the feed assembly is actuatable along the first axis toward the rock face to engage a head of the gripper against the rock face and stabilize the boom against the rock face.

14. The screen handling system of claim 1, wherein the actuator drives the consumable through a mesh screen and into the rock face once the gripper is engaged with the mesh screen and stabilized against the rock face to inhibit inadvertent movement of the feed assembly while driving the consumable into the rock face.

15. A rock drilling device for use on a boom of a mining machine, the rock drilling device comprising:

a feed assembly;

a first frame at least partially supported by the feed assembly for translational movement relative to the boom along a first axis and a second frame supported for translational movement relative to the first frame;

a drill feed coupled to the second frame for rotating and advancing a consumable into a rock face along a second axis that is parallel to the first axis; and a screen handler configured to connect to and maneuver a screen relative to the rock face by rotating the screen, the screen handler including, a pad disposed proximate the consumable, and drive mechanism including a hydraulic motor, a worm gear driven by the hydraulic motor about a motor axis, and a worm wheel that meshes with the worm gear, the pad being driven to rotate with the worm wheel, the drive mechanism capable of rotating the pad in one direction of rotation through an infinite number of rotations.

16. The rock drilling device of claim 15, wherein the screen handling system further includes a block having a bore that defines a second axis parallel to the first axis, and a gripper at least partially disposed within and axially moveable relative to the bore in a direction along the second axis, wherein the drive mechanism is coupled to the block that is capable of continuously rotating the pad about the second axis to a desired orientation.

17. The rock drilling device of claim 16, wherein the worm gear has helical teeth and the worm wheel has corresponding helical teeth that mesh with the helical teeth of the worm gear.

18. The rock drilling device of claim 15, wherein the feed assembly is actuatable along the first axis toward the rock face to engage a head of a gripper against the rock face and stabilize the boom of the mining machine against the rock face.

19. A method of installing a screen on a rock face, the method comprising:

grasping the screen with a stinger assembly by securing a portion of the screen between a pad and a gripper;

actuating a feed assembly that supports the stinger assembly to extend toward the rock face until the screen is adjacent the rock face;

continuously rotating the pad and the screen via a slew drive mechanism to precisely position the screen in a desired orientation relative to the rock face;

engaging the gripper against the rock face to stabilize the feed assembly relative to the rock face; and driving a consumable through the screen and into the rock face to hold the screen against the rock face.

20. The method of claim 19, further comprising stopping rotation of the pad and the screen by deactivating a hydraulic motor of the slew drive mechanism.

21. The method of claim 19, wherein grasping the screen with the stinger assembly includes advancing a head of the gripper through the screen and holding the screen with a neck of the gripper that has a reduced-diameter compared to the head to inhibit the screen from inadvertently disengaging the gripper.

22. The method of claim 21, wherein rotating and counter-rotating the pad and the screen is performed about a stinger axis along which the gripper is actuatable, and wherein driving the consumable is performed along a drill axis that is parallel to the stinger axis.

23. The method of claim 19, further comprising continuously counter-rotating the pad and the screen via the slew drive mechanism to precisely position the screen in a desired orientation relative to the rock face.

* * * * *